US006090747A

United States Patent [19]

Dronzek

[11] Patent Number: 6,090,747

[45] Date of Patent: Jul. 18, 2000

[54] THERMOSENSITIVE DIRECT IMAGE-RECORDING MATERIAL

[75] Inventor: Peter J. Dronzek, Thornwood, N.Y.

[73] Assignee: Labelon Corporation, Canandaigua, N.Y.

[21] Appl. No.: 08/767,937

[22] Filed: Dec. 17, 1996

[51] Int. Cl.[7] ..... B41M 5/40

[52] U.S. Cl. ..... 503/201; 427/152; 430/200; 503/200; 503/226

[58] Field of Search ..... 427/150–152; 503/200, 226, 216, 217, 210; 430/200

[56] References Cited

U.S. PATENT DOCUMENTS

| | | | |
|---|---|---|---|
| Re. 35,640 | 10/1997 | Hofta et al. | 503/200 |
| 3,080,254 | 3/1963 | Grant, Jr. | 117/36.8 |
| 4,273,602 | 6/1981 | Kosaka et al. | 156/234 |
| 4,370,370 | 1/1983 | Iwata et al. | 428/40 |
| 4,551,738 | 11/1985 | Maruta et al. | 503/200 |
| 4,570,169 | 2/1986 | Kasamatsu et al. | 503/200 |
| 4,675,705 | 6/1987 | Marginean et al. | 503/209 |
| 4,886,774 | 12/1989 | Doi | 503/226 |
| 4,892,602 | 1/1990 | Oike et al. | 156/233 |
| 5,079,212 | 1/1992 | Ishida et al. | 503/226 |
| 5,273,808 | 12/1993 | Mano et al. | 428/195 |
| 5,296,440 | 3/1994 | Kanda et al. | 503/208 |
| 5,424,182 | 6/1995 | Marginean, Sr. et al. | 430/617 |
| 5,432,534 | 7/1995 | Maruyama et al. | 347/172 |
| 5,472,930 | 12/1995 | Podzun et al. | 503/214 |
| 5,753,587 | 5/1998 | Podszun et al. | 503/210 |
| 5,773,386 | 6/1998 | Langan | 503/226 |

FOREIGN PATENT DOCUMENTS

| | | | |
|---|---|---|---|
| 63-236683 | 10/1988 | Japan | 503/226 |
| 8-768794 | 10/1988 | Japan . | |
| WO 95/31800 | 11/1995 | WIPO . | |

*Primary Examiner*—Bruce H. Hess
*Attorney, Agent, or Firm*—Nixon, Hargrave, Devans & Doyle LLP

[57] ABSTRACT

A direct image-recording material has a layer of a thermosensitive layer formed on a thin substrate. The substrate comprises an organic polymeric material that is substantially transparent and colorless and has a thickness no greater than about 10 $\mu$m. Preferred embodiments of the invention further include a support sheet with an interposed first adhesive layer on the thermosensitive composition layer. Other preferred embodiments further include a second adhesive layer and a backing sheet, which may be releasable, on the support sheet.

51 Claims, 1 Drawing Sheet

THERMOSENSITIVE DIRECT IMAGE-RECORDING MATERIAL

FIELD OF THE INVENTION

This invention relates to thermosensitive image-recording materials and more particularly to a direct recording material having a thermosensitive composition on a thin substrate.

BACKGROUND OF THE INVENTION

A great variety of thermal recording materials and processes, which are based on the application of heat or other high intensity radiation to selected portions of thermosensitive media, are known in the art. Many of these processes entail diffusion transfer, whereby a color-producing substance is transferred from a heated medium to an image-receiving layer. U.S. Pat. No. 4,892,602, for example, discloses thermally promoted transfer of a colorant from a metal deposition layer to plain paper. Similarly, U.S. Pat. No. 5,273,808 describes thermal transfer media containing inorganic and organic pigments and dyes as colorants.

In contrast to thermal transfer, a direct thermal recording process produces a desired image in a heat-sensitive material, with no subsequent transfer step. Direct thermal recording requires simpler processing equipment than transfer imaging; it is also ecologically advantageous in that it does not generate by-product materials requiring disposal.

Direct thermal image recording materials find widespread use in varied applications. They can be employed, for example, with infrared copying machines to produce images on transparent or translucent supports such as plastic films or on opaque supports such as paper, as disclosed in U.S. Pat. Nos. 4,551,738; 5,079,212; 5,296,440; and 5,424,182, the disclosures of which are incorporated herein by reference.

Other applications of direct thermal image recording include media used in cash registers, calculators, scientific instruments, and the like, as well as various sorts of tickets and tags. A particularly important application is the printing of adhesive labels, as described in U.S. Pat. Nos. 4,370,370; 4,570,169; and 4,886,774, the disclosures of which are incorporated herein by reference.

Various imaging chemistry systems have been utilized in direct thermal image recording materials. The use of mono-, oligo-, and polysaccharides together with a catalyst such as a protic or Lewis acid is described in U.S. Pat. No. 5,472,930, the disclosure of which is incorporated herein by reference. An image-producing combination of a noble metal salt of an organic acid such as silver behenate and an inorganic reducing agent such as a gallic acid ester is disclosed in the previously cited U.S. Pat. No. 5,424,182. A very frequently employed direct thermal imaging chemistry system entails the use of a colorless or pale-colored dye precursor, or leuco dye, with an acidic dye-forming agent such as a phenolic compound. Materials utilizing leuco dyes are described in the aforementioned U.S. Pat. Nos. 4,370,370; 4,551,738; 4,570,169; 4,886,774; 5,079,212; and 5,296,440, the disclosures of which have been incorporated herein by reference.

Thermal recording materials are frequently subject to conditions that impair the permanence of the recorded images. In some instances, subsequent erasure of an image may be desired, as with the reversible thermosensitive coloring compositions described in U.S. Pat. No. 5,432,534. More often, however, enhancing the stability of recorded images is sought. Thermal recording materials often exhibit poor resistance to physical abrasion. In addition, the recorded images may suffer photodegradation by ultraviolet radiation, a problem discussed in the previously mentioned U.S. Pat. No. 4,886,774. Images may also be attacked by moisture or other agents such as plasticizers that diffuse into recording material through either its front or rear surface. Protective overcoats or barrier layers for direct thermal recording materials are described, for example, in the previously mentioned U.S. Pat. Nos. 4,370,370; 4,551,738; 4,570,169; 5,079,212; 5,296,440; and 5,424,182.

Embodiments of the present invention provide thermosensitive direct image-recording materials having high resistance to abrasion and other physical damage as well as to ultraviolet and chemical degradation of the recorded images.

SUMMARY OF THE INVENTION

The present invention has to do with a direct image-recording material having a layer of a thermosensitive composition captured between a thin substrate and a support sheet of film or paper, and a process for making this material. The thermosensitive layer is preferably formed on the thin substrate, which comprises an organic polymeric material that is substantially transparent and colorless and has a thickness no greater than about 10 $\mu$m.

A preferred embodiment further comprises a support sheet with a first adhesive layer interposed between the thermosensitive composition layer and the support sheet. The adhesive may be applied to either the thermosensitive composition layer or the support sheet prior to their being bonded together. Other preferred embodiments further include a barrier layer, or a second adhesive layer and a laminated backing sheet that may be releasable, on the support sheet. Other thermally imageable composite constructions of thermosensitive layers and various materials selected for particular properties and applications may be produced by similar lamination techniques; such constructions are more economical and less technically demanding than multilayer structures produced solely by repeated coating steps.

The present invention provides, in addition to the previously described image stability and composite flexibility benefits, an advantage in imaging efficiency resulting from the excellent heat transfer from a print head through the thin polymeric substrate to the thermosensitive layer. In those embodiments where the thermosensitive layer is adhered to a support sheet, the thin substrate serves as a protective layer overlying the recorded image.

DETAILED DESCRIPTION OF THE INVENTION

Figure 1:
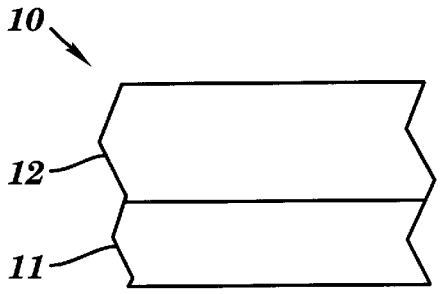
FIGS. 1, 2, 3, and 4 are schematic cross-sectional representations of embodiments of the direct image-recording material of the present invention.

FIG. 1 schematically depicts an embodiment 10 of the recording material of the invention that includes a substrate 11 and a layer 12 of a thermosensitive composition. Recording material 10 may be wound into rolls for commercial distribution or utilized in the fabrication of recording material embodiments represented by FIGS. 2 and 3.

Figure 2:
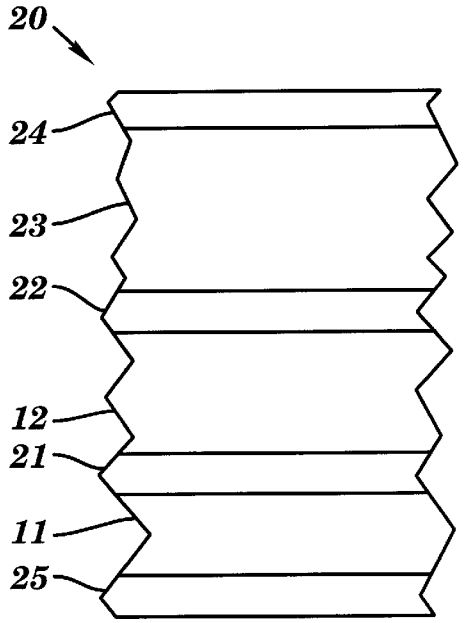

FIG. 2 depicts a further embodiment 20 that includes a primer layer 21 between substrate 11 and thermosensitive composition layer 12. A first adhesive layer 22 bonds layer 12 to support sheet 23. An optional barrier or functional layer 24 is formed on support sheet 23. In addition, an optional skin layer 25, which may be overcoated on or coextruded with substrate 11, is disposed on the outer surface of substrate 11.

Substrate 11 comprises a substantially transparent and colorless organic polymeric material having a thickness no greater than about 10 μm, preferably about 2 μm to 9 μm, more preferably about 4 μm to 7 μm. The polymeric material of substrate 11 may be a polyester, polyamide, polyimide, polyurethane, polycarbonate, polyolefin, fluoropolymer, or mixtures thereof. A polyester is preferred; polyethylene terephthalate is especially preferred.

Thermosensitive composition layer 12, whose thickness may range from about 2 μm to 100 μm depending on its chemical components and its intended application, includes a thermal imaging chemistry system, which is preferably either a combination of an organic acid noble metal salt and an organic reducing agent or a combination of a substantially colorless dye precursor, i.e., a leuco dye, and an acidic dye-forming agent. A preferred organic acid noble metal salt is silver behenate, and a preferred organic reducing agent is an alkyl ester of gallic acid such as, for example, propyl gallate. The composition may also include an image-toning agent such as, for example, phthalazone. Procedures for forming thermosensitive layers containing these ingredients are well known in the art and are included in, for example, the aforementioned U.S. Pat. No. 5,424,182 and in U.S. Pat. No. 3,080,254, the disclosure of which is incorporated herein by reference.

For leuco dye thermal imaging systems, suitable basic leuco dye compounds are listed in columns 12–16 of the previously mentioned U.S. Pat. No. 5,432,534, the disclosure of which is incorporated herein by reference. Suitable organic and inorganic acidic dye-forming agents, including phenolic compounds, as well as useful binders are listed in columns 5–6 of the aforementioned U.S. Pat. No. 5,079,212, the disclosure of which is incorporated herein by reference.

First adhesive layer 22, used to bond support sheet 23 to thermosensitive layer 12, includes a one- or two-part laminating adhesive agent that may be pressure-sensitive or nonpressure-sensitive, and may be a wax, a resin, or an elastomer such as, for example, a natural or synthetic wax, an acrylic or vinyl acetate resin, a styrene-butadiene or isoprene elastomer, or mixtures thereof.

Support sheet 23 may, depending on the intended use of recording material 20, be relatively thick or thin, transparent or opaque, or translucent. It may be formed of paper, cardboard, or a variety of synthetic polymers, including water-soluble polymers that serve as a barrier against the intrusion of harmful chemical agents such as plasticizers into thermosensitive composition layer 12. A separate polymeric barrier or functional layer 24 may be optionally formed on support sheet 23.

Also as shown in FIG. 2, a thin, i.e., 5 μm or less, skin layer 25 may be formed either by overcoating or coextrusion on the outer surface of substrate 11. Skin layer 25 may include an anti-stick agent to forestall possible sticking of a thermal print head to substrate 11, and may also be formulated as a release layer for self-wound pressure-sensitive labels. Suitable anti-stick agents include, for example, Teflon, organofunctional silicones, and styrene-acrylic, polycarbonate, polyurethane, and silicone resins.

Skin layer 25 may also contain an ultraviolet protective material, such as is disclosed in the previously mentioned U.S. Pat. No. 4,886,774, to protect a thermal recorded image in layer 12 from photodegradation. Alternatively, the ultraviolet protective agent may be included in substrate 11.

Figure 3:
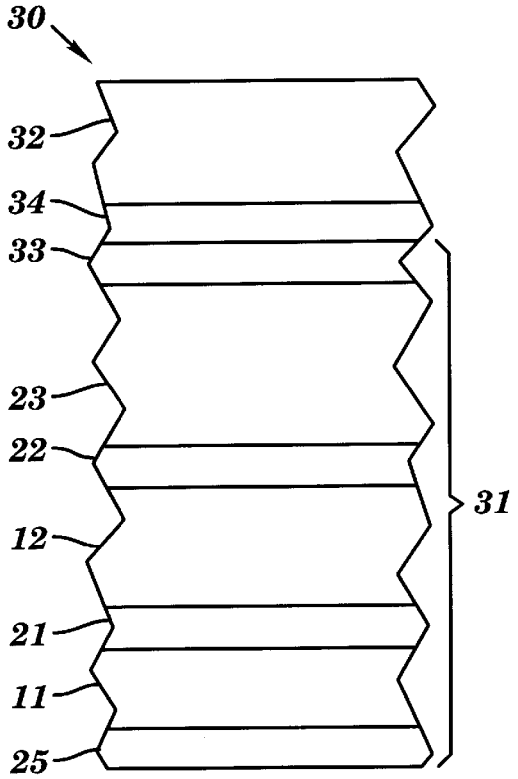

FIG. 3 schematically depicts an embodiment 30 of the invention that comprises a pressure-sensitive adhesive label 31 and a backing sheet 32. Label 31 includes, in addition to substrate 11, optional primer layer 21, thermosensitive composition layer 12, first adhesive layer 22, support sheet 23, and skin layer 25 (all substantially as described for embodiment 20 of FIG. 2), a second adhesive layer 33.

Second adhesive layer 33 includes a pressure-sensitive adhesive agent that may be a wax, resin, or elastomer, known to those in the art. Backing sheet 32 is a paper or a film that is releasable from adhesive layer 33 for subsequent disposal. To facilitate separation from adhesive layer 33, sheet 32 may be provided with a release layer 34 containing an release agent such as, for example, a silicone resin.

Figure 4:
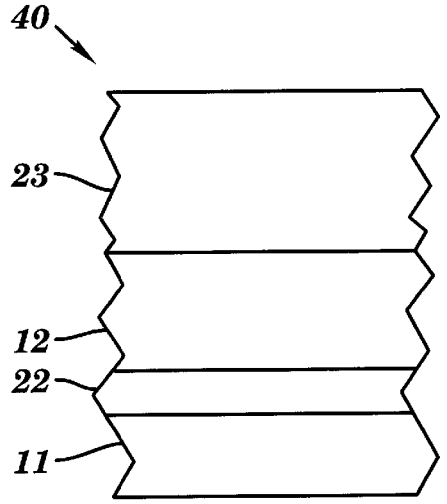

A further embodiment 40 of the invention, shown in FIG. 4, comprises a thermosensitive composition layer 12 formed on support sheet 23 and thin transparent substrate 11 laminated to layer 12 by adhesive layer 22, which may include a one- or two-part adhesive agent. The elements of material 40 are similarly constituted to the analogous elements of embodiments 20 and 30 (FIGS. 2 and 3).

The following examples further illustrate the invention:

EXAMPLE 1

Formation of a Thermosensitive Direct Image Recording Material

On a 22 gauge (5.6 μm thick) oriented polyethylene terephthalate (PET) substrate (available from Rhone Poulenc or DuPont) is coated a leuco dye thermal imaging composition, such as that described, for example, in U.S. Pat. No. 4,675,705, the disclosure of which is incorporated herein by reference. The thermosensitive layer may be imaged by exposure through the substrate.

EXAMPLE 2

Formation of a Thermosensitive Direct Image Recording Durable Tag

Following application of a priming layer to an 18 gauge (4.6 μm thick) oriented PET substrate (available from Rhone Poulenc), a leuco dye imaging composition is applied as described in Example 1. A bonding layer containing about 1.5 lb./3000 sq.ft. of an aziridine-crosslinked polyurethane adhesive (PD384-20 grade, available from Adhesion Systems) is applied to the imaging layer. A corona-treated 6-mil high density polyethylene (HDPE) sheet (available from Pierson Industries) is laminated to the thermosensitive layer.

A clay-containing layer for flexographic ink reception is applied at a laydown of 2 lb./3000 sq.ft. to the HDPE sheet. An anti-stick layer of silicone or fluoropolymer containing an ultraviolet absorber is applied to the surface of the PET substrate opposite the thermosensitive layer, which is imageable by exposure through the substrate.

EXAMPLE 3

Formation of a Self-wound Pressure-sensitive Label

A thermal imaging layer is applied as described in Example 1 to a 22 gauge (5.6 μm thick) oriented PET substrate (available from Rhone Poulenc or DuPont). A release layer containing, for example, 0.3 lb./sq.ft. of SYL- OFF 23™ (available from Dow Chemical Co.) is applied to the reverse side of the substrate. A bonding layer containing Hydroflex™ adhesive (available from H.B. Fuller Co.) at 1.3 lb./3000 sq.ft. is formed on the imaging layer. To this bonding layer is laminated a 2.8-mil white Labelyte™ oriented polypropylene support sheet (available from Mobil Chemical Co.). A pressure-sensitive layer of Duro-Tak™ adhesive (available from National Starch & Chemical Corp.) is coated at 16 lb./3000 sq.ft. on the support sheet. The resulting structure is useful for making a self-wound roll of adhesive labels.

EXAMPLE 4

Formation of a Pressure-sensitive Label With a Backing Sheet

To the pressure-sensitive layer of the structure described in Example 3 is releasably laminated a Neverstik™ backing sheet, available from Eastern Fine Papers, Bangor, Me., and consisting of 50 lb. densified kraft paper provided with a silicone release layer to facilitate separation of the label from the backing sheet.

In accordance with the present invention, an image-recording material comprising a thermosensitive composition layer on a thin, transparent, colorless polymeric substrate is combinable with a variety of support and backing sheets, thereby providing direct recording materials for such diverse applications as copy papers and transparencies, placards, tags, tickets, and labels. Furthermore, images recorded in the materials of the invention are protected against physical damage as well as chemically induced deterioration and photodegradation in both indoor and outdoor environments.

While the present invention has been described in terms of certain preferred embodiments, one skilled in the art will readily appreciate that various modifications, additions, omissions, and substitutions may be made without departing from the spirit thereof.

What is claimed is:

1. A thermosensitive direct image-recording material comprising:

a substrate; and a layer of a thermosensitive composition formed on a first surface of said substrate;

characterized in that said substrate comprises an organic polymeric material, is substantially transparent and colorless, and has a thickness no greater than about 7 μm.

2. The image-recording material of claim 1 wherein said organic polymeric material is selected from the group consisting of a polyester, a polyamide, a polyimide, a polyurethane, a polycarbonate, a polyolefin, a fluoropolymer, and mixtures thereof.

3. The image-recording material of claim 2 wherein said organic polymeric material is a polyester.

4. The image-recording material of claim 3 wherein said polyester is polyethylene terephthalate.

5. The image-recording material of claim 1 wherein said substrate has a thickness of about 2 μm to 7 μm.

6. The image-recording material of claim 5 wherein said substrate has a thickness of about 4 μm to 7 μm.

7. The image-recording material of claim 1 further comprising:

a support sheet permanently or releasably bonded to said thermosensitive composition layer.

8. The image-recording material of claim 7 wherein said support sheet is selected from the group consisting of paper, cardboard, and synthetic polymer.

9. The image-recording material of claim 7 further comprising:

a first adhesive layer interposed between said thermosensitive composition layer and said support sheet.

10. The image-recording material of claim 7 further comprising:

a backing sheet disposed on said support sheet.

11. The image-recording material of claim 10 wherein said backing sheet is selected from the group consisting of paper and synthetic polymer.

12. The image-recording material of claim 10 further comprising:

a second adhesive layer interposed between said support sheet and said backing sheet.

13. The image-recording material of claim 12 wherein said backing sheet is releasable from said second adhesive layer.

14. The image-recording material of claim 1 wherein said substrate further comprises an ultraviolet protective agent.

15. The image-recording material of claim 1 further comprising:

a skin layer disposed on a second, outer surface of said substrate.

16. The image-recording material of claim 15 wherein said skin layer comprises an anti-stick agent.

17. The image-recording material of claim 15 wherein said skin layer comprises an ultraviolet protective agent.

18. The image-recording material of claim 1 wherein said thermosensitive composition comprises a substantially colorless dye precursor and a dye-forming agent.

19. The image-recording material of claim 18 wherein said dye precursor comprises an alkaline leuco dye and said dye-forming agent comprises a phenolic material.

20. The image-recording material of claim 1 wherein said thermosensitive composition comprises a noble metal salt of an organic acid and an organic reducing agent.

21. The image-recording material of claim 20 wherein said noble metal salt of an organic acid comprises silver behenate and said organic reducing agent comprises an alkyl ester of gallic acid.

22. The image-recording material of claim 20 wherein said thermosensitive composition further comprises an image-toning agent.

23. The image-recording material of claim 22 wherein said image-toning agent comprises phthalazone.

24. A process for making a thermosensitive image-recording material comprising:

forming on a first surface of a substrate a layer of a thermosensitive composition capable of forming a stable image;

characterized in that said substrate comprises a film of an organic polymer material, is substantially transparent and colorless, and has a thickness no greater than about 7 μm.

25. The process of claim 24 wherein said organic polymeric material is selected from the group consisting of a polyester, a polyamide, a polyimide, a polyolefin, a polycarbonate, and mixtures thereof.

26. The process of claim 25 wherein said organic polymeric material is a polyester.

27. The process of claim 26 wherein said polyester is polyethylene terephthalate.

28. The process of claim 24 wherein said substrate has a thickness from about 2 μm to no greater than 7 μm.

29. The process of claim 28 wherein said substrate has a thickness between 4 μm and 7 μm.

30. A process for forming an image in a thermal recording material, said process comprising:

applying high intensity radiation from a radiation source in an imagewise fashion through a substrate of a direct image-recording material comprising a layer of a thermosensitive composition formed on said substrate;

wherein said substrate comprises an organic polymeric material that is substantially transparent and colorless, and has a thickness no greater than about 10 $\mu$m;

wherein said direct image-recording material further comprises a support sheet permanently or releasably bonded to a surface of said thermosensitive composition layer opposite said substrates; and wherein a stable image is formed by said thermosensitive composition.

31. The process of claim 30 wherein said support sheet is selected from the group consisting of paper, cardboard, and synthetic polymer.

32. The process of claim 30 further comprising:

applying a second adhesive layer to said support sheet; and permanently or releasably bonding a backing sheet to said second adhesive layer.

33. The process of claim 32 wherein said backing sheet is selected from the group consisting of paper and synthetic polymer.

34. The process of claim 32 wherein said backing sheet is releasably adhered to said second adhesive layer.

35. The process of claim 30 wherein said substrate further comprises an ultraviolet protective agent.

36. The process of claim 30 further comprising:

forming a skin layer comprising an anti-stick agent on a second, outer surface of said substrate.

37. The process of claim 30 wherein said thermosensitive composition comprises a substantially colorless dye precursor and a dye-forming agent.

38. The process of claim 37 wherein said dye precursor comprises an alkaline leuco dye and said dye-forming agent comprises a phenolic compound.

39. The process of claim 30 wherein said thermosensitive composition comprises a noble metal salt of an organic acid and an organic reducing agent.

40. The process of claim 39 wherein said noble metal salt of an organic acid comprises silver behenate and said organic reducing agent comprises an alkyl ester of gallic acid.

41. The process of claim 39 wherein said thermosensitive composition further comprises an image-toning agent.

42. The process of claim 41 wherein said image-toning agent comprises phthalazone.

43. The process of claim 30 further comprising:

permanently or releasably bonding a surface of said thermosensitive composition layer opposite said substrate to a support sheet.

44. The process of claim 30 wherein said thermosensitive composition comprises a substantially colorless dye precursor and a dye-forming agent.

45. The process of claim 30 wherein said thermosensitive composition comprises a noble metal salt of an organic acid and an organic reducing agent.

46. A thermosensitive direct image-recording material comprising:

a support sheet;

a layer of a thermosensitive composition formed on a surface of said support sheet; and a thin, substantially transparent and colorless organic polymeric substrate having a thickness no greater than about 10 $\mu$m, said substrate being permanently or releasably bonded to said thermosensitive composition layer by an adhesive layer.

47. The image-recording material of claim 46 wherein said support sheet is selected from the group consisting of paper, cardboard, and synthetic polymer.

48. The image-recording material of claim 46 wherein said thin substrate is formed from a polymeric material selected from the group consisting of a polyester, a polyamide, a polyimide, a polyurethane, a polycarbonate, a polyolefin, a fluoropolymer, and mixtures thereof.

49. The image-recording material of claim 48 wherein said substrate is formed from a polyester and has a thickness of about 2 $\mu$m to 9 $\mu$m.

50. The image-recording material of claim 46 wherein said thermosensitive composition comprises a substantially colorless dye precursor and a dye-forming agent.

51. The image-recording material of claim 46 wherein said adhesive layer comprises a one-part or two-part laminating adhesive agent.

* * * * *